US009109355B1

(12) United States Patent
Strauch

(10) Patent No.: US 9,109,355 B1
(45) Date of Patent: Aug. 18, 2015

(54) PERIMETER FOUNDATION WALL FOR MANUFACTURED HOMES

(76) Inventor: Norris G. Strauch, Roseburg, OR (US)

( * ) Notice: Subject to any disclaimer, the term of this patent is extended or adjusted under 35 U.S.C. 154(b) by 1513 days.

(21) Appl. No.: 12/380,240

(22) Filed: Feb. 24, 2009

Related U.S. Application Data

(60) Provisional application No. 61/067,183, filed on Feb. 25, 2008.

(51) Int. Cl.
*E04B 1/343* (2006.01)
*E04B 2/02* (2006.01)

(52) U.S. Cl.
CPC ..... *E04B 1/34342* (2013.01); *E04B 2002/021* (2013.01)

(58) Field of Classification Search
CPC ..... E04B 1/04; E04B 1/34342; E04B 2001/2684; E04B 2002/0204; E04B 2002/021
USPC ..... 52/169.5, 169.9, 169.11, 169.12, 292, 52/294, 295, 299, 126.1, 126.3; 248/188.2
See application file for complete search history.

(56) References Cited

U.S. PATENT DOCUMENTS 3,753,323 A * 8/1973 Nesbitt ..... 52/169.12
4,030,262 A * 6/1977 Dean ..... 52/587.1
4,241,554 A * 12/1980 Infantino ..... 52/314
4,352,261 A 10/1982 Wargo
4,408,940 A 10/1983 Fischer
4,738,061 A 4/1988 Herndon
5,384,993 A 1/1995 Phillips
5,428,926 A * 7/1995 Melfi ..... 52/71
5,666,774 A * 9/1997 Commins ..... 52/298
5,685,115 A * 11/1997 Colfer ..... 52/292
5,913,793 A * 6/1999 Hills ..... 52/741.13
6,076,320 A 6/2000 Butler
6,125,597 A * 10/2000 Hoffman et al. ..... 52/169.12
6,205,720 B1 3/2001 Wolfrum
6,339,904 B1 1/2002 Carrone et al.
7,328,879 B1 * 2/2008 Plangetis ..... 248/679

* cited by examiner

*Primary Examiner* — Joshua J Michener
*Assistant Examiner* — Theodore Adamos
(74) *Attorney, Agent, or Firm* — Robert E. Howard

(57) ABSTRACT

A perimeter foundation wall of a manufactured home having rim joists and a concrete footing located beneath the rim joists. The perimeter foundation wall includes a plurality of precast panels extending around the perimeter of the manufactured home. The panels have a height slightly less than the distance between the bottom of the rim joist and the top of the concrete footing. The ends of adjacent precast panels interlock. The tops of the panels are held in abutment with the bottom of the rim joist by support means located between the bottom of the panels and the concrete footing. The tops of the panels are connected to the rim joist by at least one top connector. The bottoms of the panels are connected to the concrete footing by at least one bottom connector.

20 Claims, 7 Drawing Sheets

Fig. 2A
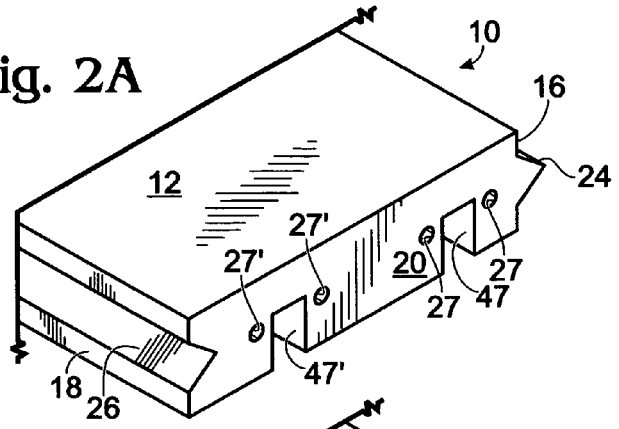
Fig. 2B
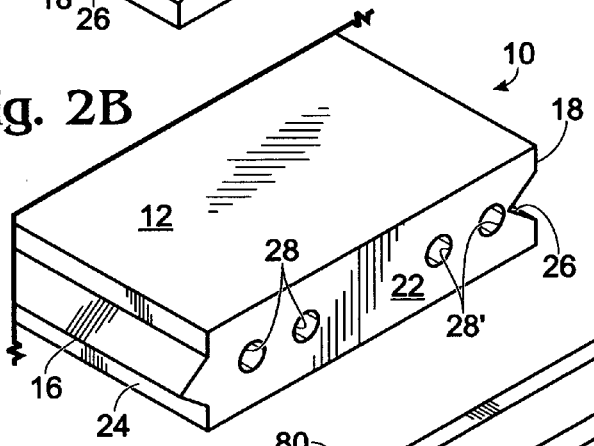
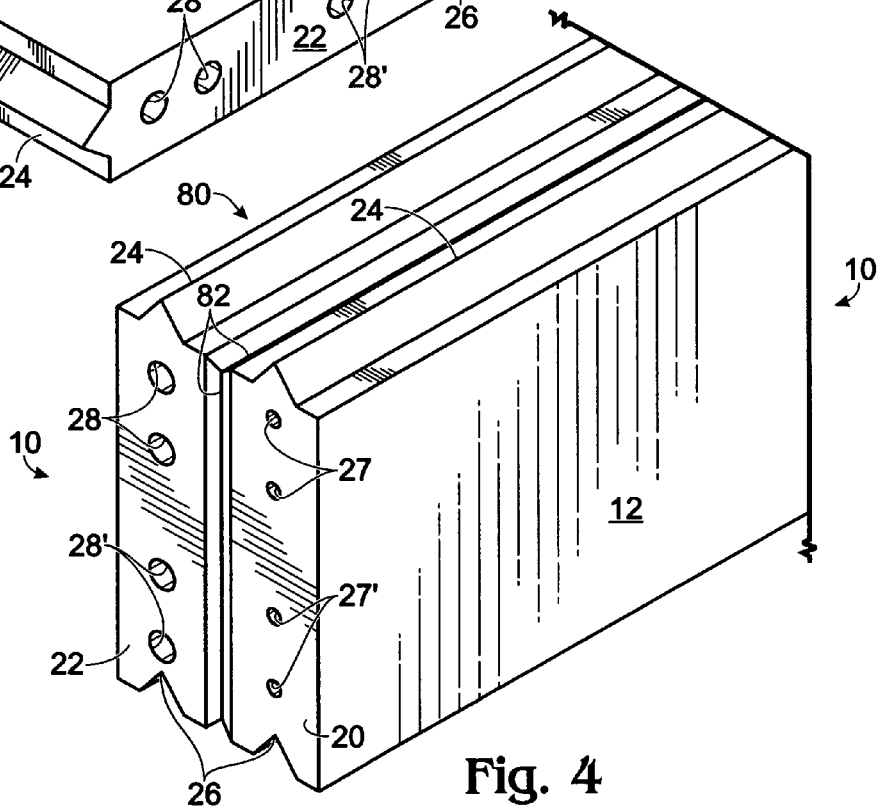
Fig. 4

Fig. 8
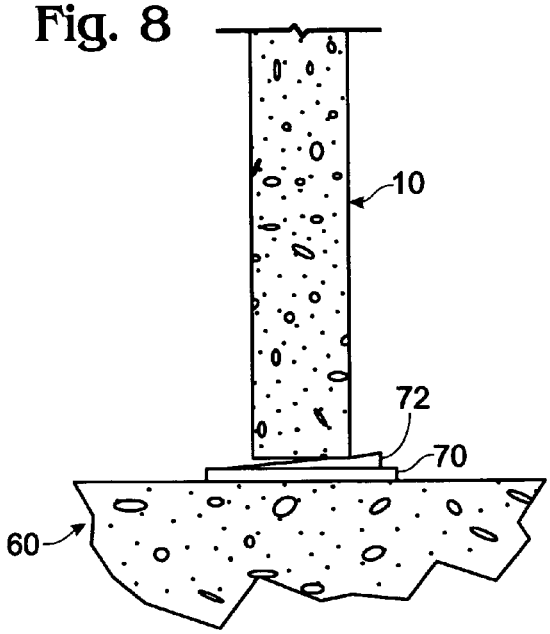
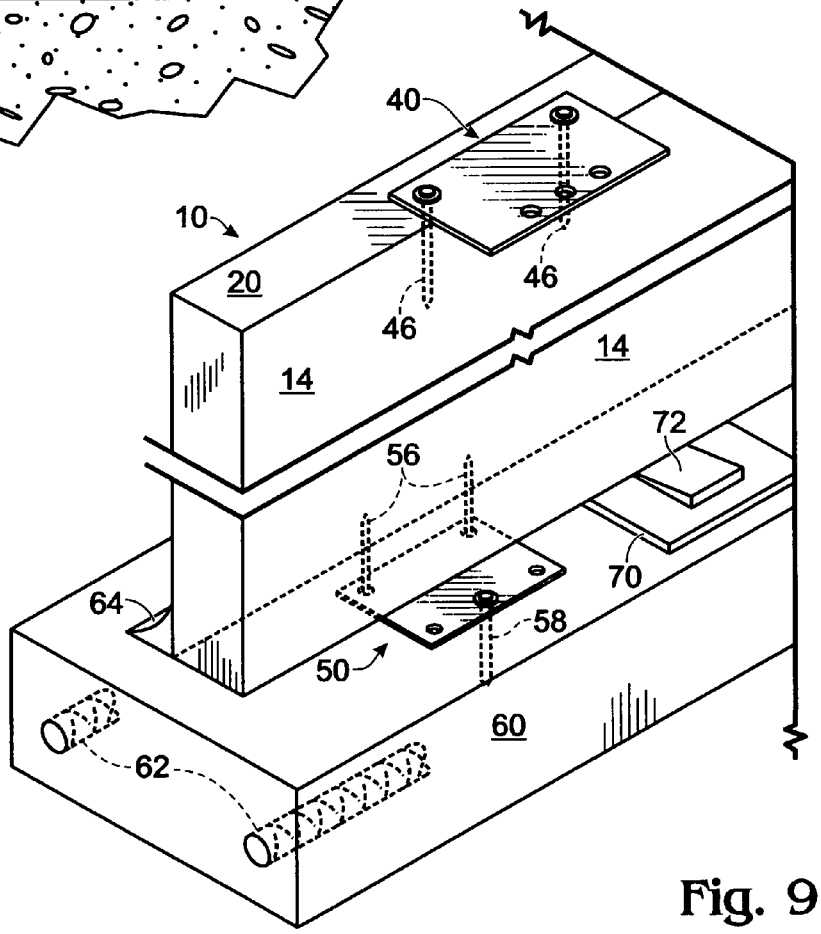
Fig. 9

PERIMETER FOUNDATION WALL FOR MANUFACTURED HOMES

CROSS-REFERENCE TO RELATED APPLICATIONS

This application claims the benefit of U.S. Provisional Application No. 61/067,183, filed Feb. 25, 2008, the entire contents of which are incorporated herein by reference.

BACKGROUND OF THE INVENTION

The present invention relates to a perimeter foundation wall for manufactured homes.

A problem with manufactured homes is the gap between the ground and rim joists of the manufactured home. This problem arises due to the method of construction. Pier footings are set in place first and then the manufactured home is seated on the pier footings.

In the past several types of skirting walls to cover this gap have been employed or suggested. Concrete block masonry can be used to construct a skirting wall, but an unsecured gap is left at the top of the concrete block wall which is typically covered with a trim, and the wall is not connected to the manufactured home. Wood framing can be used to provide a skirting wall, but presents a problem of appearance and short life span. Skirting walls do not provide any foundational support; they are for cosmetic purposes only. Such skirting walls require additional piers and/or tie-down straps to meed wind and seismic resistance to be classified as a permanent foundation for HUD and California regulations.

A concrete wall can be poured in place and the manufactured home lowered onto the wall; however, this approach is expensive.

SUMMARY OF THE INVENTION

The present invention provides a foundation wall for manufactured homes that installs easily like skirting using simple tools. The foundation wall of the present invention can withstand required horizontal and vertical load, and resist wind and seismic forces.

The perimeter foundation wall of the present invention includes a plurality of precast concrete panels extending around the perimeter of the manufactured home. A concrete footing is located beneath the rim joists of the manufactured home. Each of the panels has a height substantially equal to the distance between the bottom of the rim joists and the top of the concrete footing. The tops of each of the precast panels are connected to the rim joists of the manufactured home by at least one top connector. The bottoms of each of the precast panels are connected to a concrete footing located below the rim joists by at least one bottom connector.

BRIEF DESCRIPTION OF THE DRAWINGS

FIG. 2A is a perspective view of the top of the precast panel;

FIG. 2B is a perspective view of the bottom of the precast panel;

FIG. 4 is a perspective view of a precursor panel having a V-groove for splitting to produce two split face precast panels;

FIG. 8 is a vertical cross-sectional view of the precast panel showing a bottom support system; and FIG. 9 is a perspective view of the precast panel shown attached to a permanent foundation with a poured in place footing;

DESCRIPTION OF PREFERRED EMBODIMENTS

Figure 1:
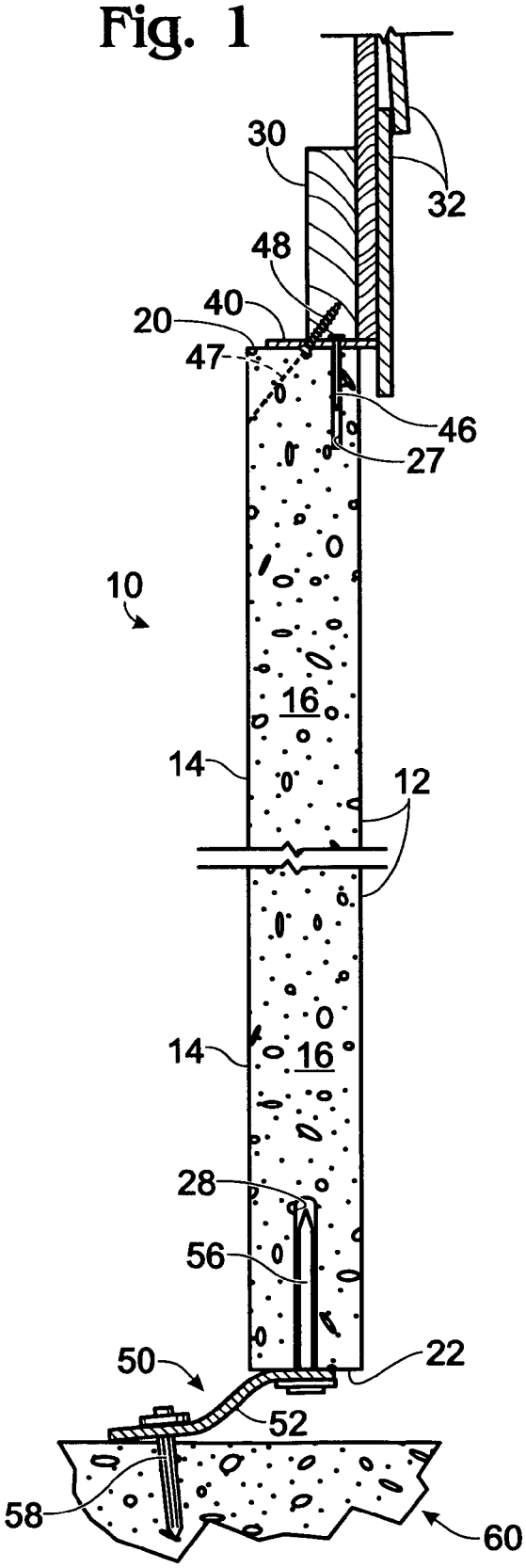
FIG. 1 is a vertical cross-sectional view of the precast panel of the present invention shown attached to a concrete footing and to the rim joist of a manufactured home.

Precast panel 10 is generally rectangular in shape and includes a front wall 12, a rear wall 14, right and left side walls 16 and 18, a top 20, and a bottom 22.

A V-shaped tongue 24 extends outwardly from the mid-portion of right side wall 16, preferably substantially along the entire distance from top 20 to bottom 22, and a V-shaped groove 26 is formed in the mid-portion of left side wall 18, preferably substantially along the entire distance from top 20 to bottom 22. V-shaped tongue 24 of panel 10 is adapted to fit into the V-shaped groove 26 of an adjacent panel 10 during assembly of the foundation to ensure alignment of adjacent panels 10, and to prevent movement. Right and left top connector cylindrical passageways 27, 27' are formed in the top 20 of panel 10, spaced substantially equally from right and left side walls 16 and 18, respectively. Right and left bottom connector cylindrical passageways 28, 28' are formed in the bottom 22 of panel 10, spaced substantially equally from right and left side walls 16 and 18, respectively.

Figure 6:
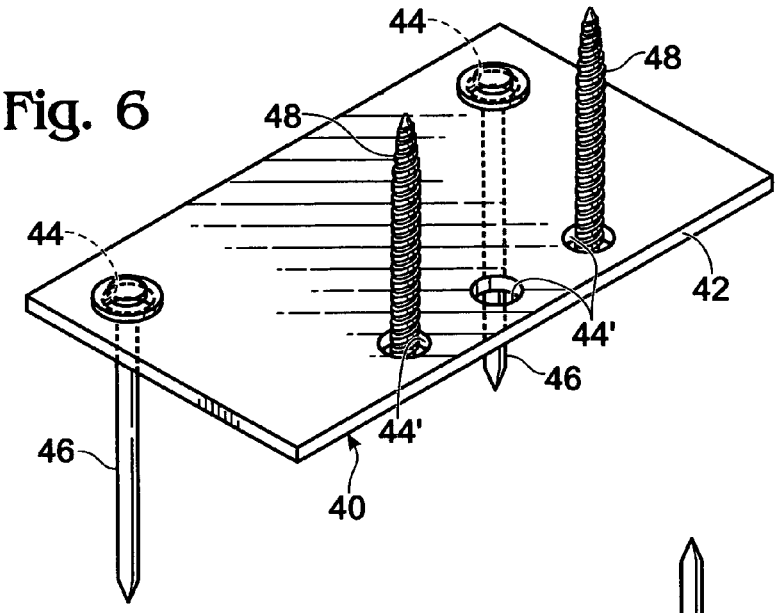
FIG. 6 is a perspective view of a top connector for attaching a precast panel to the rim joist.

Each panel 10 can be connected to the rim joist 30 of a mobile home by means of at least one top connector member 40, preferably by at least two top connector members 40. Top connector members 40 can be a steel strap. A preferred top connector member 40 is shown in FIG. 6, and includes a generally rectangular shaped body 42 and plurality of circular openings 44 and 44' through which fastening members 46 and 48 pass, respectively. Fastening members 46 are preferably a rod having a head, and can be, for example, 16 penny galvanized nails. Fastening members 48 are threaded fastening members, and can be, for example, 1.5 inch #8 screws.

Figure 10:
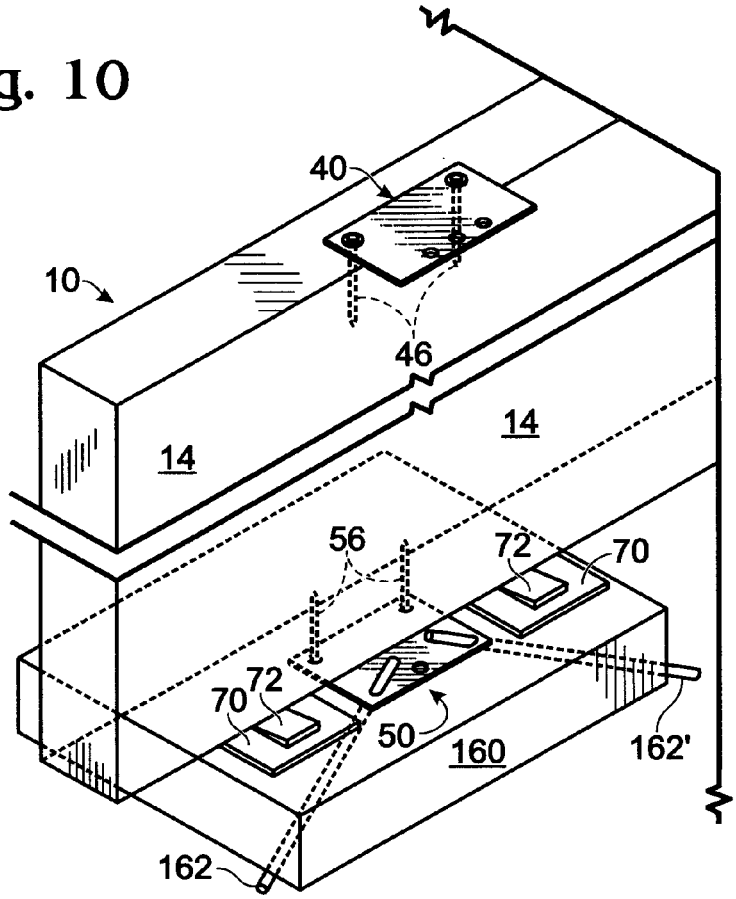
FIG. 10 is a perspective view of the precast panel shown attached to a permanent foundation with precast footing pads.

FIG. 1 shows a panel 10 connected to rim joist 30 by right side top connector member 40. Fastening members 46 are passed through openings 44 positioned towards the ends of top connector members 40 and into right and left top connector cylindrical passageways 27, 27'. Only right side top connector member 40 is shown in FIG. 1. The panel 10 is raised so that the top 20 thereof is in abutment with rim joist 30, and held in place by any suitable means, such as shims 70 and wedges 72, as seen in FIGS. 8-10. A screw 48, or other threaded fastener, is passed through an opening 44 positioned towards the middle of top connector member 40 and screwed into rim joist 30 at an angle, as shown in FIG. 1. Sloping channels 47, 47' allow screws 48 to be accessed for screwing.

Figure 7:
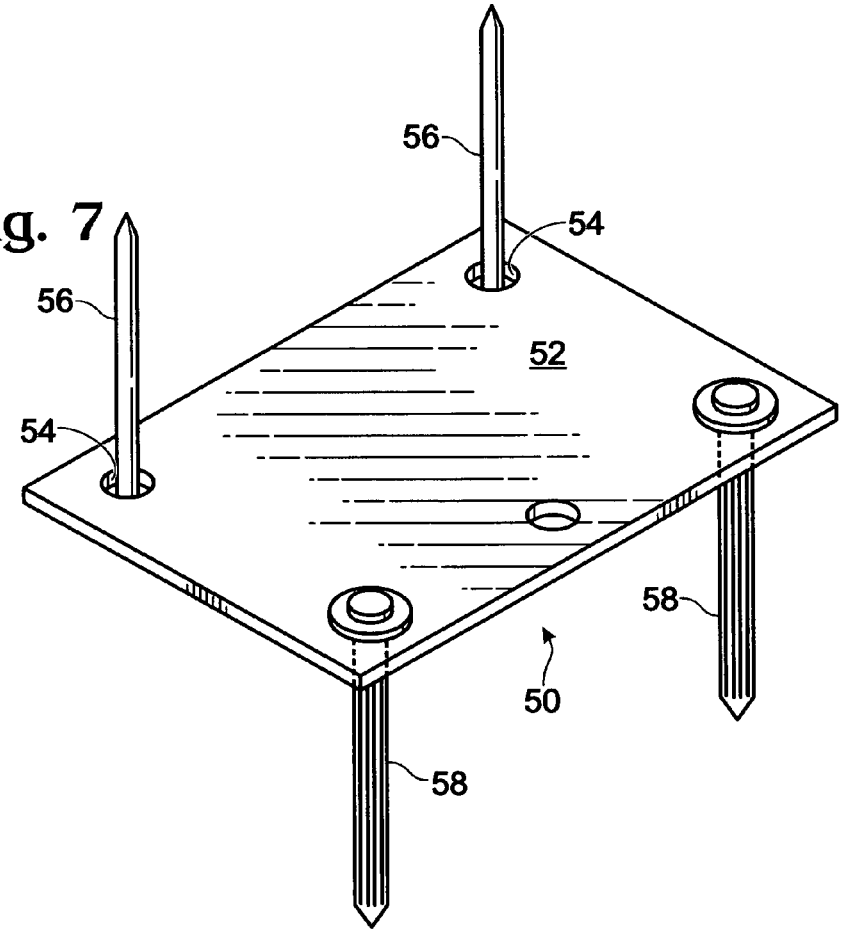
FIG. 7 is a perspective view of a bottom connector for attaching a precast panel to a concrete footing.

Each precast panel 10 includes at least one bottom connector member 50, and preferably at least two bottom connector members 50. A bottom connector member 50 is shown in FIG. 7, and includes a rectangular plate member 52 Plate 52 of bottom connector 50 is attached to the bottom of precast panel 10 by passing fastening members 56 through openings 54 and into cylindrical passageways 28 formed in the bottom 22 of panel 10. Fastening members 56 can, for example, be 16 penny galvanized nails. Plate 52 of bottom connector member 50 is attached to concrete footing 60 by means of concrete nails 58.

Figure 3A:
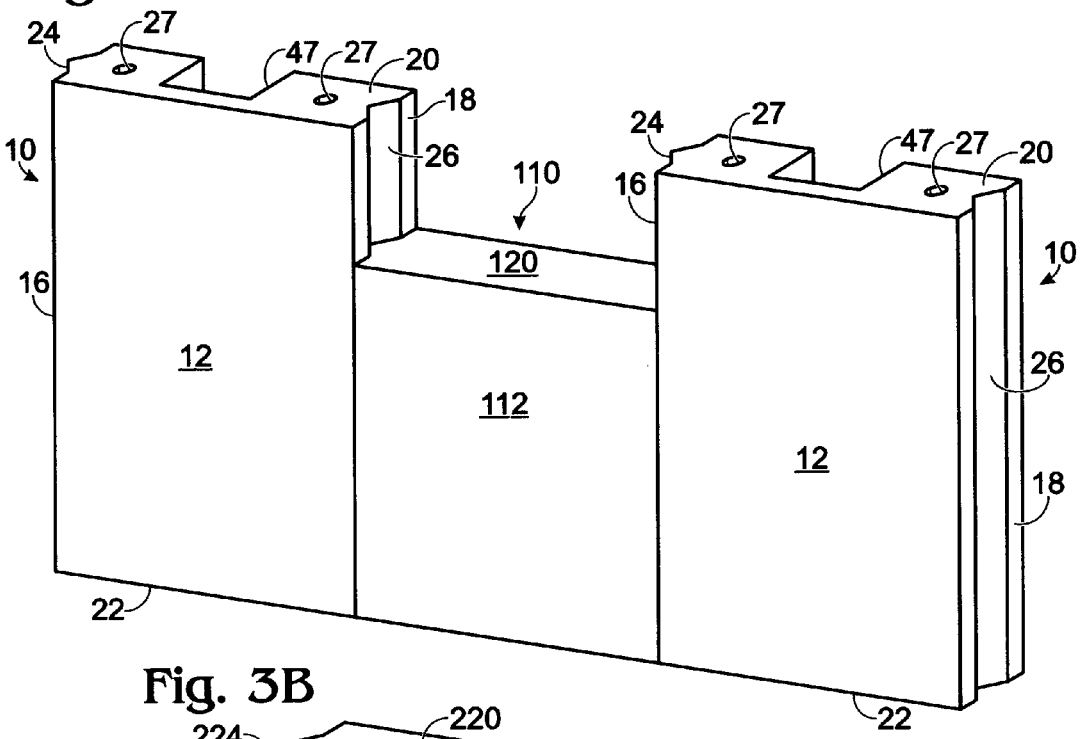
FIG. 3A is a perspective view of a first embodiment of a vent opening configured as a separate, shorter precast panel.
Figure 3B:
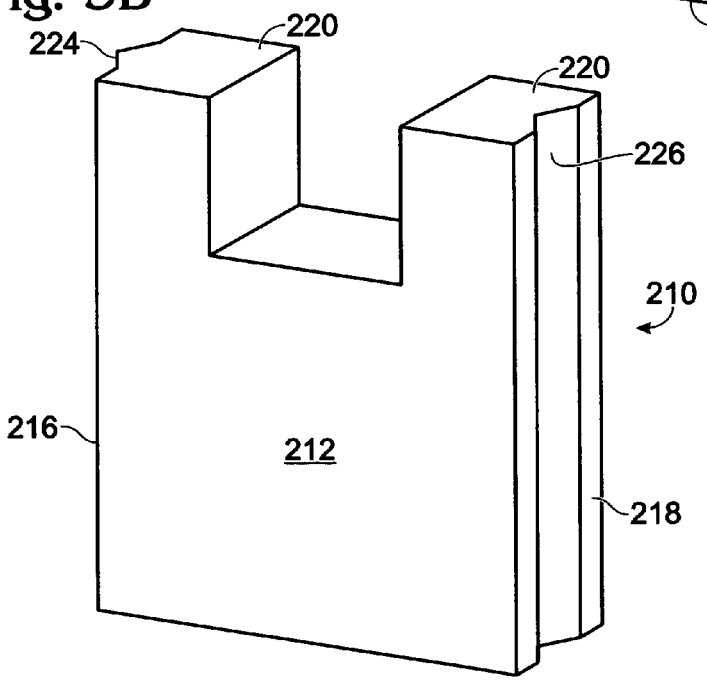
FIG. 3B is a perspective view of a second embodiment of a vent opening formed in the precast panel itself.

The perimeter foundation wall formed by a plurality of precast panels 10 must provide for ventilation of the crawl space. FIGS. 3A and 3B show two embodiments that provide for vent screen openings in the wall.

In FIG. 3A, two regular precast panels 10 are separated by a shortened precast panel 110 which provides a rectangular space between the upper portions of precast panels 10 to allow insertion of a vent screen and frame (not shown). Shortened precast panel 110 is held in place by a left side and a right side tongue and groove (not shown) identical to tongue 24 and groove 26 of precast panel 10, and is fastened to the concrete footing of the manufactured home by bottom connector members 50 in the same manner as precast panels 10.

In FIG. 3B, a specialized precast panel 210 is formed with a rectangular opening in the mid upper portion thereof to allow insertion of a vent screen and frame (not shown). The rectangular opening can be formed by cutting the opening out of a precast panel 10 with a concrete saw, or formed during molding of the panel 210. A V-shaped tongue 224 is formed in right side wall 216, and a mating V-shaped groove 226 is formed in left side wall 218.

Figure 5A:
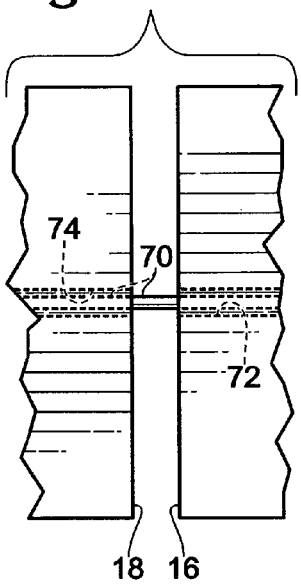
FIGS. 5A-5F are partial front elevational views of precast panels having various interlocking configurations.
Figure 5B:
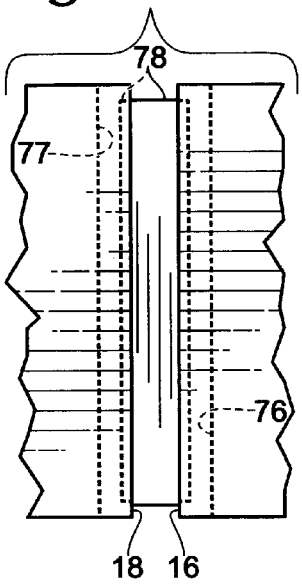
Figure 5C:
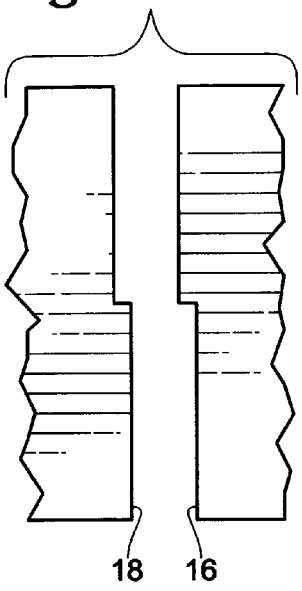
Figure 5D:
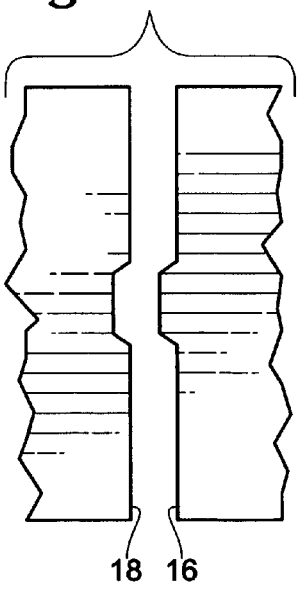
Figure 5E:
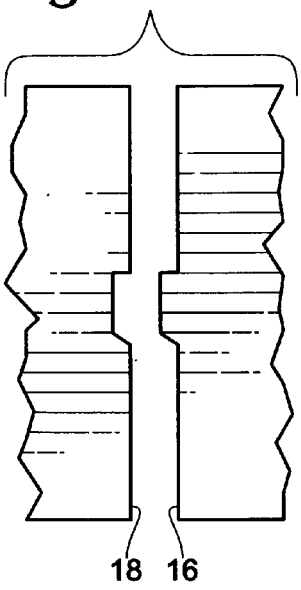
Figure 5F:
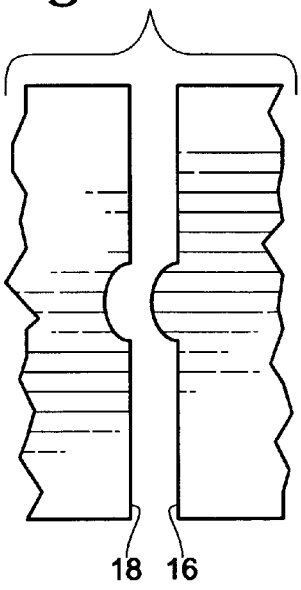

FIGS. 5A-5F show various ways alternative to the tongue 24 and groove 26 of FIGS. 2 and 3 for mating adjacent precast panels 10. In FIG. 5A, a steel rod 70 is inserted into aligned right and left openings 72 and 74 of adjacent precast panels 10. In FIG. 5B adjoining right and left side walls 16 and 18 have abutting slots 76 and 77 into which an insert bar 78 is snugly placed. In FIG. 5C, the upper portion of the left side walls 18 are indented to matingly receive a protruding portion of the upper portion of right side walls 16 of adjacent precast panels 10. In FIG. 5D, a mid portion of the left side walls 18 of precast panels 10 are indented to receive a protruding portion of right side walls 16 of adjacent precast panels 10. FIGS. 5E and 5F show other configurations of mating indentations and protrusions in the mid portion of the right and left side walls 16 and 18.

Figure 11:
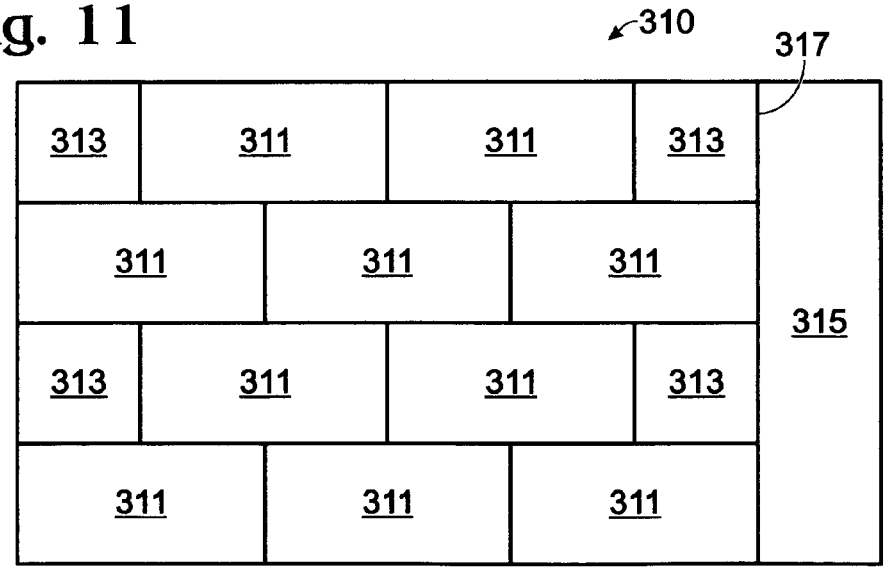
FIG. 11 is a front elevation view of the precast panel showing a preferred facial pattern.

The precast panels 10 of the present invention can be made by any suitable means, such as forming in a mold or extrusion. The outer surface of the precast panels are preferably formed to simulate stone, brick, or other building material. A preferred pattern is shown in FIG. 11 which shows a precast panel 310 having an outer surface that simulates stone blocks 311 and 313 in a running bond pattern. At one end of the panel 310 a column 315 is molded having a faux seam 317. When placed next to an identical precast panel 310 in forming the foundation wall, the two panels can be joined with a real seam that duplicates faux seam 317, thereby disguising the joint between the panels.

One method of forming the precast panels 10 is to mold a "split face block" 80, as shown in FIG. 4. Split face block 80 has a V-shaped groove 82 extending completely around the mid portion of the perimeter thereof. A splitter blade is urged against the V-shaped groove 82 to break apart the two adjacent blocks 10 in a manner well known in the concrete block art. Each of the outer faces of the two blocks 10, when broken apart, has a texture simulating stone.

The concrete footing 60 on which the precast concrete panels 10 of the perimeter wall rest can be formed by pouring cement at the location of the mobile home. The footing should contain appropriate steel reinforcement bars 62. A concrete seal 64 is preferably formed against the bottom of front wall 12 at its juncture with footing 60, as best seen in FIG. 9. Soil backfill can be placed against the front wall 12 up to about six inches from the top 20 of precast panel 10.

Alternatively, a concrete footing can be preformed in sections or pads 160, as best seen in FIG. 10.

A still further alternative is to temporarily support precast panel 10 in abutment with rim joist 30, such as by use of support means similar to pads 160, placing form boards adjacent the bottoms 22 of precast panels 10, and pouring cement into the forms. Attachment between the poured footing and precast panels 10 can be accomplished by pieces of steel rebar (preferably three per panel) attached perpendicularly to the bottoms 22 of the precast panels 10 and held in place by strap members similar to top connector members 40

It will be obvious to those having skill in the art that many changes may be made to the details of the above-described embodiments of this invention without departing from the underlying principles thereof. The scope of the present invention should, therefore, be determined only by the following claims.

The invention claimed is:

1. A perimeter foundation wall of a manufactured home having rim joists and a concrete footing located below said rim joists comprising:

a plurality of precast panels extending around a bottom perimeter of said manufactured home, substantially all of said precast panels having a height substantially equal to, but slightly less than, a distance between a bottom of said rim joists and a top of said concrete footing, said panels being configured to provide a foundation wall that can withstand horizontal and vertical loads and resist wind and seismic forces;

each of said precast panels having a top, a bottom, and right and left side walls;

said top of each of said precast panels being in abutment with the bottom of said rim joist, and means for maintaining said abutment;

at least one top connector member attaching the top of each of said panels to said rim joist;

at least one bottom connector member attaching the bottom of each of said panels to said concrete footing in a manner such that each of said panels is supported by said concrete footing thereby forming a foundation for said manufactured home.

2. The perimeter foundation wall of claim 1 wherein said means for maintaining said top of each of said precast panels in abutment with the bottom of said rim joist is at least one support member positioned between said bottom of said precast panels the top of said concrete footing.

3. The perimeter foundation wall of claim 2 wherein said support member is a wedge-shaped member.

4. The perimeter foundation wall of claim 3 wherein said support member includes a shim placed beneath said wedge-shaped member.

5. The perimeter foundation wall of claim 1 wherein each of said top connector members includes a body having at least two openings therein, one of said openings receiving a precast panel fastening member therethrough to fasten said top connector member to the top of one of said precast panels, another of said openings receiving a fastening member therethrough to fasten said top connector member to said rim joist.

6. The perimeter foundation wall of claim 5, wherein each of said precast panel fastening members is a rod member that is driven into an opening in the top of one of said precast panels said rod member having a head.

7. The perimeter foundation wall of claim 5 wherein each of said top connector members has a generally rectangular shaped body.

8. The perimeter foundation wall of claim 1 including a plurality of vent screen openings.

9. The perimeter foundation wall of claim 8 wherein each of said vent screen openings is provided by placing a shortened precast panel between two of said precast panels having a height substantially equal to the distance between the bottom of said rim joist and the top of said concrete footing, said shortened precast panel being attached at its bottom to said concrete footing by at least one bottom connector member.

10. The perimeter foundation wall of claim 8 wherein each of said vent screen openings is provided by removing a portion of a precast panel adjacent the top thereof to thereby provide a vent screen opening of a size adapted to receive a vent screen.

11. The perimeter foundation wall of claim 1 wherein one of said right and left side walls of each of said precast panels having a V-shaped tongue extending outwardly therefrom, the other of said right and left side walls of each of said precast panels having a V-shaped groove configured to receive a V-shaped tongue from an adjacent precast panel.

12. A perimeter foundation wall around a bottom periphery of a manufactured home, said bottom periphery including a rim joist, comprising:

a concrete footing located beneath the bottom periphery of said manufactured home, said concrete footing having an upper surface;

a plurality of precast panels, each of said panels having a top, a bottom, and right and left side walls, said panels being configured to provide a foundation wall that can withstand horizontal and vertical loads and resist wind and seismic forces;

one of said right and left side walls of each of said precast panels having a V-shaped tongue extending outwardly therefrom, the other of said right and left side walls of each of said recast panels having a V-shaped groove configured to receive a V-shaped tongue from an adjacent precast panel;

said top of each of said plurality of precast panels being held in abutment with a bottom of said rim joist by at least one support member positioned between said bottom of said precast panels and the upper surface of said concrete footing said top of each of said precast panels having at least one top connector member attached thereto and attached to said rim joist of the manufactured home;

said bottom of said precast panels having at least one bottom connector member attached thereto and attached to said concrete footing.

13. The perimeter foundation wall of claim 12 wherein said support member is a wedge-shaped member.

14. The perimeter foundation wall of claim 13 wherein said support member includes a shim placed beneath said wedge-shaped member.

15. The perimeter foundation wall of claim 12 wherein each of said top connector members includes a body having at least two openings therein, one of said openings receiving a precast panel fastening member therethrough to fasten said top connector member to the top of one of said precast panels, another of said openings receiving a fastening member therethrough to fasten said top connector member to said rim joist.

16. The precast panel of claim 15, wherein each of said top connector members is attached to the top of one of said precast panels by a rod member driven into an opening in the top of one of said precast panels said rod member having a head.

17. The perimeter foundation wall of claim 15 wherein each of said top connector members has a generally rectangular shaped body.

18. The perimeter foundation wall of claim 12 including a plurality of vent screen openings.

19. The perimeter foundation wall of claim 18 wherein each of said vent screen openings is provided by placing a shortened precast panel between two of said precast panels having a height substantially equal to the distance between the bottom of said rim joist and the top of said concrete footing, said shortened precast panel being attached at its bottom to said concrete footing by at least one bottom connector member.

20. The perimeter foundation wall of claim 18 wherein each of said vent screen openings is provided by removing a portion of a precast panel adjacent the top thereof to thereby provide a vent screen opening of a size adapted to receive a vent screen.

* * * * *